US010009682B2

(12) United States Patent
Schoeffmann et al.

(10) Patent No.: US 10,009,682 B2
(45) Date of Patent: Jun. 26, 2018

(54) ELECTROACOUSTIC TRANSDUCER

(71) Applicant: Sound Solutions International Co., Ltd., Beijing (CN)

(72) Inventors: Michael Schoeffmann, Baden (AT); Erich Klein, Himberg (AT); Heribert Bauer, Siegendorf (AT)

(73) Assignee: Sound Solutions International Co., Ltd., Beijing (CN)

( * ) Notice: Subject to any disclaimer, the term of this patent is extended or adjusted under 35 U.S.C. 154(b) by 0 days. days.

(21) Appl. No.: 15/286,823

(22) Filed: Oct. 6, 2016

(65) Prior Publication Data

US 2017/0099548 A1 Apr. 6, 2017

Related U.S. Application Data

(60) Provisional application No. 62/237,961, filed on Oct. 6, 2015.

(51) Int. Cl.

| | |
|---|---|
| ***H04R 1/28*** | (2006.01) |
| *H04R 9/06* | (2006.01) |
| *H04R 31/00* | (2006.01) |

(52) U.S. Cl.

CPC ..... *H04R 1/288* (2013.01); *H04R 9/06* (2013.01); *H04R 31/006* (2013.01);

(Continued)

(58) Field of Classification Search

CPC . H04R 1/00; H04R 1/06; H04R 1/288; H04R 9/025; H04R 9/04

(Continued)

(56) References Cited

U.S. PATENT DOCUMENTS 4,037,061 A * 7/1977 von Recklinghausen .... H04R 9/047 381/408

8,098,877 B2 * 1/2012 Meyer ..... H04R 9/063 381/392

(Continued)

FOREIGN PATENT DOCUMENTS

CN 202663529 U 1/2013

CN 104038855 A 9/2014

(Continued)

OTHER PUBLICATIONS

International Search Report and Written Opinion of ISA, Int'l Appl. No. PCT/CN2016/101673, dated Jan. 3, 2017.

(Continued)

*Primary Examiner* — Gerald Gauthier

(74) *Attorney, Agent, or Firm* — Steven McMahon Zeller; Dykema Gossett PLLC

(57) ABSTRACT

A new audio transducer for mobile devices having a collar with side openings that provide side venting to a back volume within an enclosure. The side openings eliminate the need for a typical frame and back vents thereon, which leads to a smaller size speaker. Each of the side openings have a maximum size less than the size of an adsorber material, which prevents the adsorber material coming into contact with the magnets, coil, and membrane of the speaker. The side openings and the size thereof also permit the enclosure to be directly filled with an adsorber material. The direct filling of the adsorber leads to more even and complete distribution of the adsorber within the back volume, which, in turn, improves sound quality of the speaker.

19 Claims, 12 Drawing Sheets

(52) U.S. Cl.
CPC .... *H04R 2201/029* (2013.01); *H04R 2499/11* (2013.01); *H04R 2499/15* (2013.01)

(58) Field of Classification Search
USPC ..... 181/151, 160; 381/162, 333, 346, 353, 381/386, 396, 398, 400, 408, 412, 429, 381/191, 433
See application file for complete search history.

(56) References Cited

U.S. PATENT DOCUMENTS 8,315,421 B2 * 11/2012 Mihelich ..... H04R 9/025 381/412
8,379,904 B2 * 2/2013 Liu ..... H04R 9/063 181/181
8,379,907 B2 * 2/2013 Yan ..... H04R 7/04 381/396
8,630,441 B2 * 1/2014 Shi ..... H04R 9/063 381/398
8,794,373 B1 * 8/2014 Lin ..... B01D 53/0407 181/151
9,258,631 B1 * 2/2016 Xu ..... H04R 9/06
9,584,921 B2 * 2/2017 Shi ..... H04R 9/025
2005/0205350 A1 * 9/2005 Yang ..... H04R 1/025 181/160
2009/0052721 A1 * 2/2009 Dabrowski ..... A61C 17/22 381/386
2010/0061584 A1 * 3/2010 Lin ..... H04R 1/02 381/386
2010/0220889 A1 * 9/2010 Adelman ..... H04R 11/02 381/412
2012/0093353 A1 * 4/2012 Windischberger ..... H04R 1/22 381/396
2012/0243719 A1 * 9/2012 Franklin ..... G06F 1/1652 381/333
2013/0016874 A1 * 1/2013 Huang ..... H04R 9/043 381/433
2013/0030881 A1 11/2013 Shen
2014/0056464 A1 * 2/2014 Li ..... H04R 9/025 381/400
2014/0064540 A1 * 3/2014 Lin ..... H04R 1/2803 381/346
2015/0110336 A1 * 4/2015 Song ..... H04R 1/025 381/412
2015/0181345 A1 * 6/2015 Cai ..... H04R 9/06 381/412
2015/0304776 A1 * 10/2015 Backman ..... H04R 1/00 381/398
2016/0014485 A1 * 1/2016 Chu ..... H04R 9/025 381/162
2016/0021441 A1 * 1/2016 Shao ..... H04R 9/10 381/412
2017/0099536 A1 * 4/2017 Schoeffmann ..... H04R 1/06
2017/0099548 A1 * 4/2017 Schoeffmann ..... H04R 1/288

FOREIGN PATENT DOCUMENTS

CN 104067634 A 9/2014
CN 104427444 A 3/2015
CN 204498363 U 7/2015
EP 2348754 A1 7/2011
EP 2495991 A1 9/2012
WO 2015054226 A1 4/2015

OTHER PUBLICATIONS

First Office Action and search report issued for counterpart Taiwan patent application No. 105132319, dated Mar. 14, 2018 dated Mar. 5, 2018.
First Office Action and search report issued for counterpart Taiwan patent application No. 105132319, dated Mar. 14, 2018.

* cited by examiner

ELECTROACOUSTIC TRANSDUCER

BACKGROUND OF THE INVENTION a. Field of the Invention

The invention relates to an audio transducer, such as a speaker to transduce an electrical audio signal into acoustic sound or a receiver to transduce an acoustic sound into an electrical audio signal. This invention furthermore relates to a micro speaker optimized for high acoustic output and located within a small volume of a mobile device, such as a mobile phone, a tablet, a gaming device, a notebook or similar device.

b. Background Art

Prior art micro speakers are housed within an enclosure that provides a back volume for the speaker. Often the back volume is filled with an adsorber material which leads to an apparent virtual enlargement of the back volume. The adsorber serves to lower the resonant frequency of the speaker to a value that can only be achieved with a larger back volume in the absence of an adsorber. In prior art speakers, the enclosure may be filled with an adsorber through a small hole which leads to uneven or incomplete filling of the enclosure with the adsorber, which results in a decreased sound quality.

SUMMARY OF THE INVENTION

It is an object of the invention to have an audio transducer for mobile devices without the disadvantages of known transducers. A new audio transducer for mobile devices, in particular for a micro speaker, comprises a collar with side openings that provide side venting to a back volume within an enclosure. The side openings eliminate the need for a typical frame and back vents thereon, which leads to a smaller size speaker. Furthermore, each of the side openings have a maximum size less than the size of an adsorber material, which prevents the adsorber material coming into contact with the magnets, coil, and membrane of the speaker. The side openings and the size thereof also permit the enclosure to be directly filled with an adsorber material. The direct filling of the adsorber leads to more even and complete distribution of the adsorber within the back volume, which, in turn, improves sound quality of the speaker. Further details and advantages of such an audio transducer will become apparent in the following description and the accompanying drawings.

Briefly therefore, one aspect of the invention is directed to an audio transducer, comprising a membrane assembly, a coil assembly, and a magnet system. The membrane assembly includes a membrane having a perimeter, a membrane ring affixed to the perimeter of the membrane, and a membrane plate affixed to the membrane. The magnet system comprises a pot assembly, a perimeter magnet assembly, and an air gap formed therebetween. The pot assembly has a pot plate having a perimeter, a center magnet affixed to the pot plate, and a top plate affixed to the center magnet opposite the pot plate. The perimeter magnet assembly has a population of outer magnets arranged proximate the perimeter of the pot plate and surrounding the center magnet, and a ring plate affixed to the population of outer magnets. The audio transducer also includes a substantially rectangular collar having a first portion substantially parallel to the pot plate, a substantially rectangular hole extending through the first portion of the collar, and a second portion extending substantially perpendicular downward from the first portion. A population of openings extend through the second portion to provide side venting to a back volume. The population of openings permit direct filling of an enclosure with an adsorber. Additionally, a support tab extends substantially perpendicular outward from the second portion of the collar. The coil assembly includes a coil located in the air gap and a pair of electrical leads extending from the coil. The top side of the coil is affixed to the membrane.

While embodiments of the audio transducer are shown and described as having a rectangular shape, it will be understood that in other embodiments, the audio transducer may have a variety of shapes, including, but not limited to, circular and ovular. Accordingly, the invention is not limited to audio transducers having a rectangular shape.

BRIEF DESCRIPTION OF THE DRAWINGS

These and other aspects, features, details, utilities, and advantages of the invention will become more fully apparent from the following detailed description, appended claims, and accompanying drawings, wherein the drawings illustrate features in accordance with exemplary embodiments of the invention, and wherein:

Like reference numbers refer to like or equivalent parts in the several views.

DETAILED DESCRIPTION OF EMBODIMENTS

Figure 1:
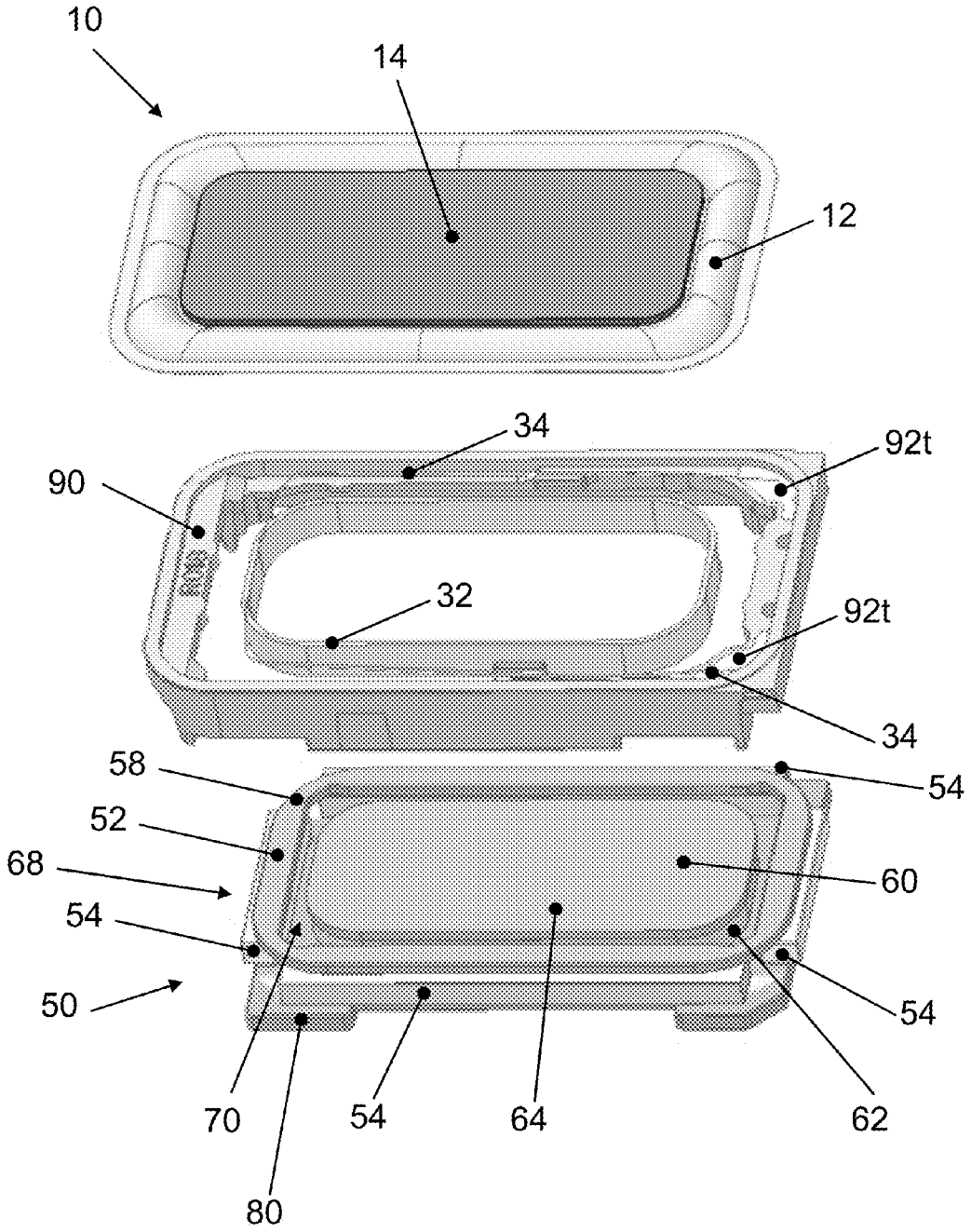
FIG. 1 (PRIOR ART)
FIG. 1 shows an exploded top perspective view of the relevant parts of a prior art rectangular micro speaker.

Various embodiments are described herein to various apparatuses. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments," "one embodiment," or "an embodiment," or the like, means that a particular feature, structure, or characteristic described in connection with the embodiment is included in at least one embodiment. Thus, appearances of the phrases "in various embodiments," "in some embodiments," "in one embodiment," or "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

It must be noted that, as used in this specification and the appended claims, the singular forms "a," "an" and "the" include plural referents unless the content clearly dictates otherwise.

The terms "first," "second," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "rear," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

All numbers expressing measurements and so forth used in the specification and claims are to be understood as being modified in all instances by the term "about."

FIG. 1 shows an exploded perspective view of the relevant parts of a prior art rectangular micro speaker 10. Speaker 10 comprises a membrane 12 that is typically built out of one or more layers of material, such as, for example, Ethere Ketone (PEEK), Acrylate and/or Thermoplastic Elastomeric (TEP), Polyetherimide (PEI), and/or other materials known in the art. Membrane 12 may also include a membrane plate 14 to stiffen membrane 12. Speaker 10 furthermore comprises a coil 32 with leads 34. An electrical signal to drive coil 32 is fed into coil 32 through leads 34. Coil 32 of assembled speaker 10 is fixed to membrane 12 with an adhesive, such as, for example, glue, tape, or other adhesives known in the art.

Speaker 10 includes a magnet system 50 comprising a perimeter magnet assembly 52 and a pot assembly 60. Perimeter magnet assembly 52 includes four magnets 54 arranged on the rectangular sides of the rectangular speaker 10 and ring plate 58 fixed to magnets 54. Pot assembly 60 includes pot plate 80, magnet 62 arranged in the center of pot plate 80, and top plate 64 fixed to magnet 62 opposite pot plate 80. Perimeter magnet assembly 52 and pot assembly 60 form magnetic field guide 68. Magnetic field guide 68 guides and focuses the magnetic field of magnets 54 and 62 in an air gap 70 between perimeter magnet assembly 52 and center magnet assembly 60, into which coil 32 is arranged in the assembled speaker 10.

Figure 2A:
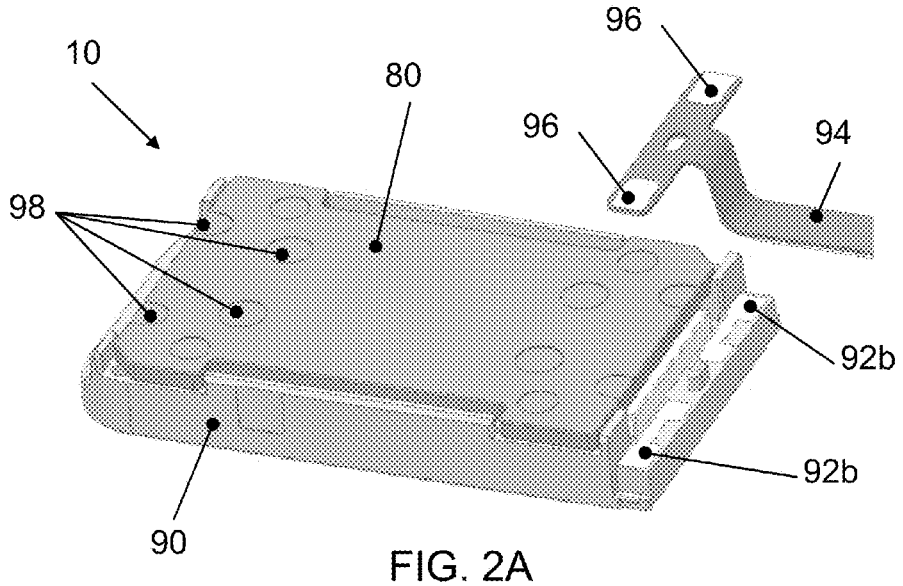
FIG. 2A (PRIOR ART)
FIG. 2A shows a bottom perspective view of the relevant parts of a prior art rectangular micro speaker.
Figure 2B:
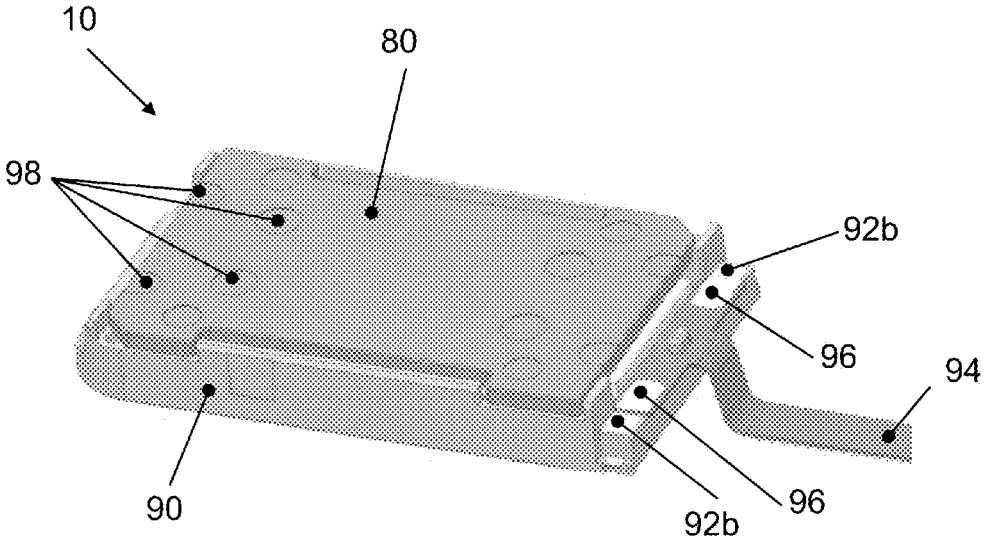
FIG. 2B (PRIOR ART)
FIG. 2B shows a bottom perspective view of the relevant parts of a prior art rectangular micro speaker.

Prior art micro speaker 10 further includes frame 90 to assemble and align membrane 12 with magnet system 50. Coil 32 fits into air gap 70 and is able to translate up and down within air gap 70 according to the electrical signal fed into coil 32 through leads 34. Frame 90 typically is made from a molded plastic which enables frame 90 to have a complex surface with openings which permit airflow and fixation of other parts of speaker 10. The ends of leads 34 of coil 32 are soldered to contact pads 92*t*, that are fixed in to top side of frame 90 during an assembly process. As shown in FIG. 2A, the bottom side of frame 90 includes contact pads 92*b* which are electrically connected with contact pads 92*t* on the top side of frame 90. As shown in FIG. 2B, a further electrical connection is made with flexible printed circuit 94 which includes contact pads 96. Contact pads 96 of flexible printed circuit 94 are soldered to contact pads 92*b* during an assembly process. The electrical signal to drive coil 32 is fed through flexible printed circuit 94, contact pads 96, contact pads 92*b*, contact pads 92*t*, and into leads 34. Furthermore as shown in FIGS. 2A and 2B, pot plate 80 includes bottom vents 98 which permit airflow between a back volume 103 (see FIGS. 3B and 3C) and the back volume side of the membrane 12. Bottom vents 98 of prior art speakers 10 are often asymmetrical, potentially contributing to tumbling of membrane 12 which can cause degradation of the acoustic performance and prematurely wear out membrane 12. Bottom vents 98 permit vibration of membrane 12 according to the electrical signal fed into coil 32.

Figure 3A:
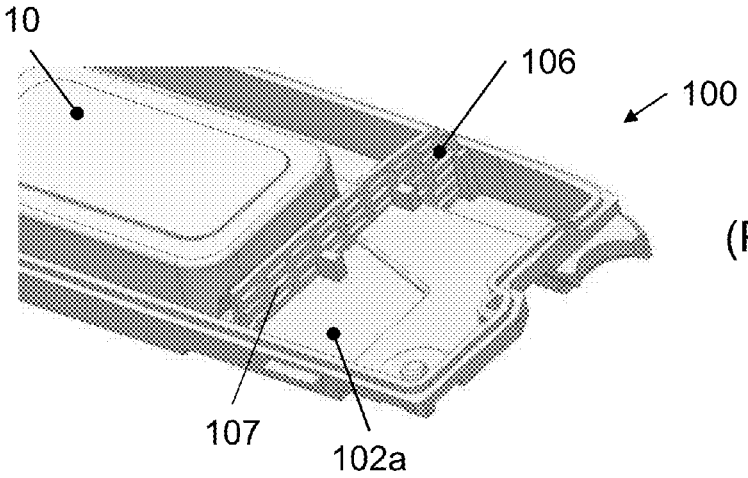
FIG. 3A (PRIOR ART)
FIG. 3A shows a top perspective view of a prior art rectangular micro speaker in a portion of a prior art enclosure.
Figure 3B:
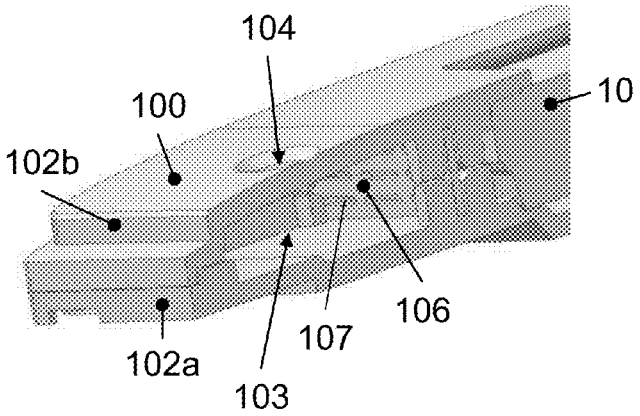
FIG. 3B (PRIOR ART)
FIG. 3B shows a side perspective section view of a prior art rectangular micro speaker in a prior art enclosure.
Figure 3C:
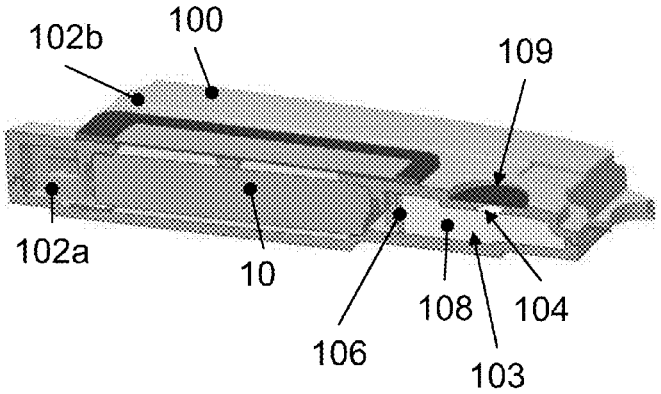
FIG. 3C (PRIOR ART)
FIG. 3C shows a side perspective section view of a prior art rectangular micro speaker in a prior art enclosure.

With reference to FIGS. 3A, 3B, and 3C, prior art micro speakers 10 are typically placed within an enclosure 100, wherein enclosure 100 provides a back volume 103 for speaker 10. Enclosure 100 may be formed of two halves like a clamshell and may include first enclosure portion 102*a* and second enclosure portion 102*b*. Speaker 10 is sandwiched between first and second enclosure portions 102*a*, 102*b*. Some applications may include an adsorber material in back volume 103. The adsorber material acts to create a larger effective back volume which can improve acoustic performance and quality. For applications that include an adsorber, a separator 106 is also typically sandwiched between first and second enclosure portions 102*a*, 102*b*. Separator 106 includes a population of holes 107 which permit airflow between membrane 12 and adsorber 108 placed in back volume 103. Holes 107 typically have a maximum dimension smaller than adsorber 108 material filled into an enclosure so that adsorber material does not come into contact with magnets 54, 62, coil 32, and membrane 12 of speaker 10.

In prior art applications, back volume 103 is filled with adsorber 108 through fill hole 104 after first and second enclosure portions 102*a*, 102*b* are mated together. After back volume 103 is filled with adsorber 108, a cover 109 such as a sticker, is placed over hole 104 to seal hole 104.

The acoustic performance and quality are highly dependent upon the amount of adsorber 108 filled into back volume 103. However, filling back volume 103 with adsorber 108 through fill hole 104 is often less than optimal. That is, adsorber 108 may bunch up or unevenly collect in portions of back volume 103 and may prevent filling back volume 103 with the desired amount of adsorber 108 called for in the particular design. This leads to the designed for acoustic performance and quality not being met. Additionally, even if the desired amount of adsorber 108 called for in the particular design is filled into back volume 103, cover 109 may eventually come loose and adsorber 108 may leak or fall out of back volume 103. This results in decreased acoustic performance and quality over time.

Figure 4:
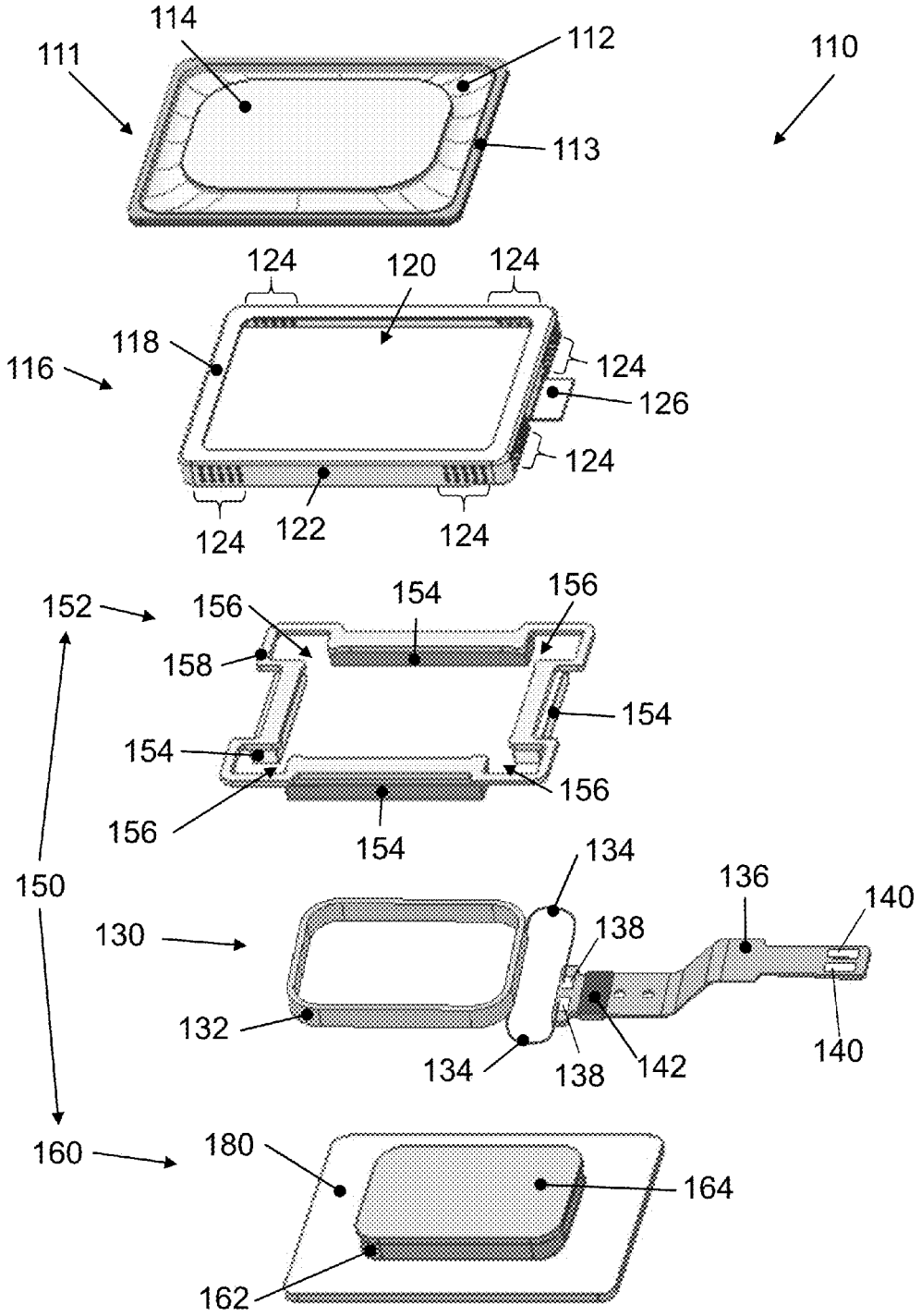
FIG. 4 shows an exploded top perspective view of a rectangular micro speaker according to a first embodiment of the invention.
Figure 5:
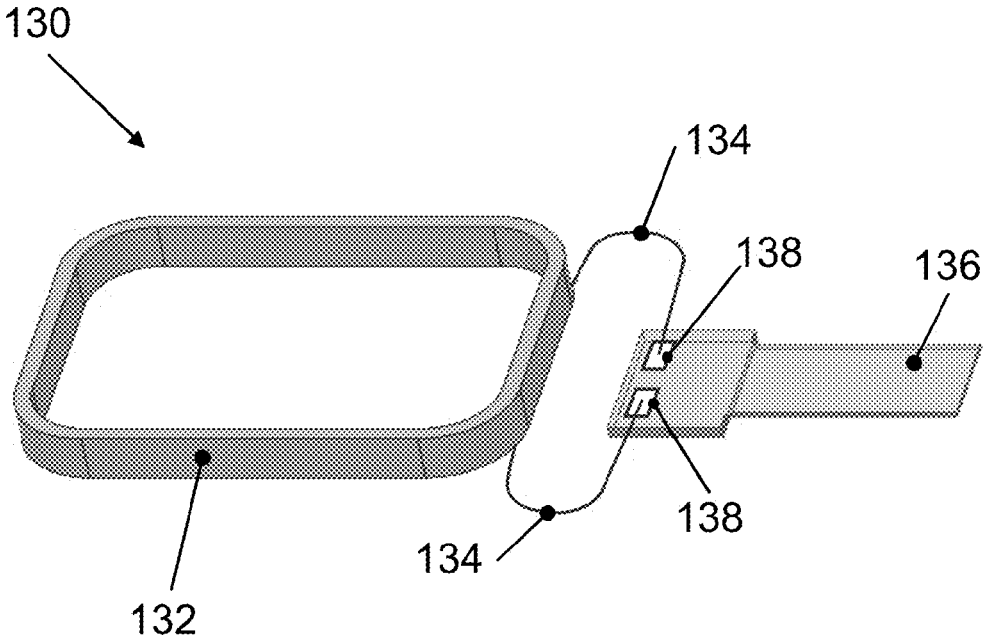
FIG. 5 shows a top perspective view of a coil assembly of a rectangular micro speaker according to the first embodiment of the invention.
Figure 6A:
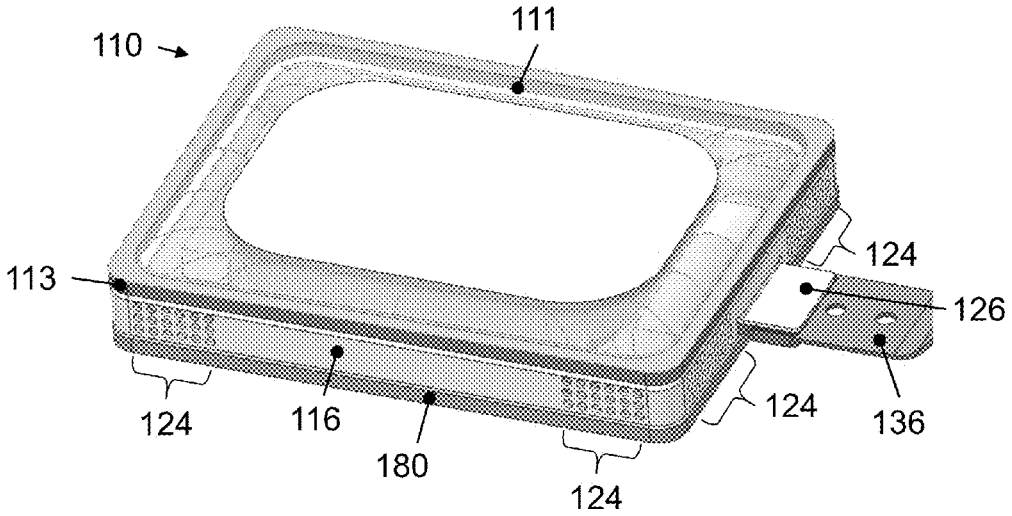
FIG. 6A shows a top perspective view of a rectangular micro speaker according to the first embodiment of the invention.
Figure 6B:
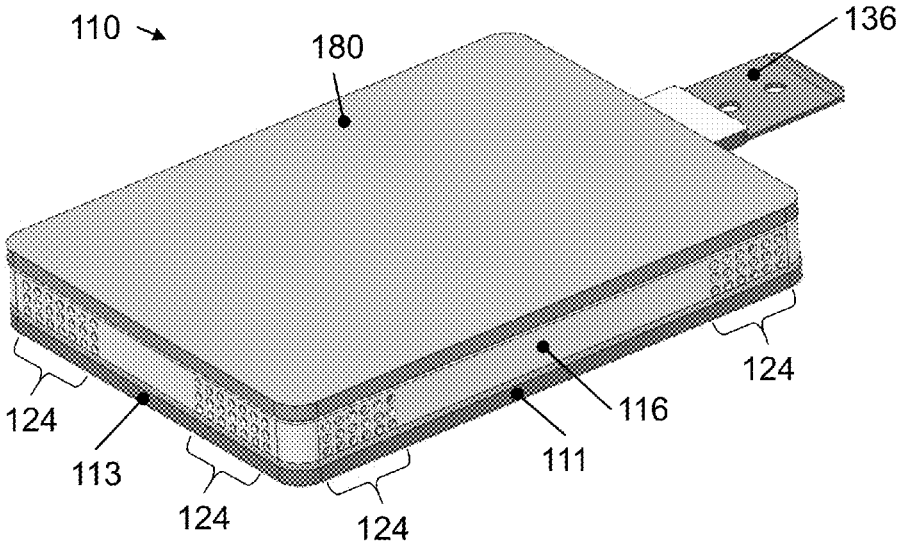
FIG. 6B shows a bottom perspective view of a rectangular micro speaker according to the first embodiment of the invention.
Figure 7:
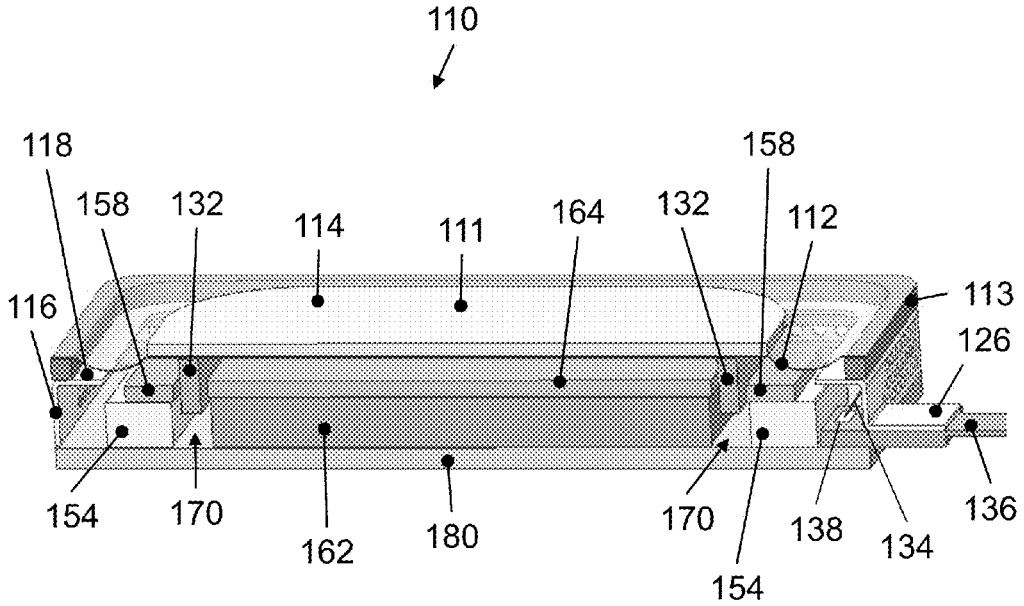
FIG. 7 shows a side perspective section view of a rectangular micro speaker according to the first embodiment of the invention.
Figure 8:
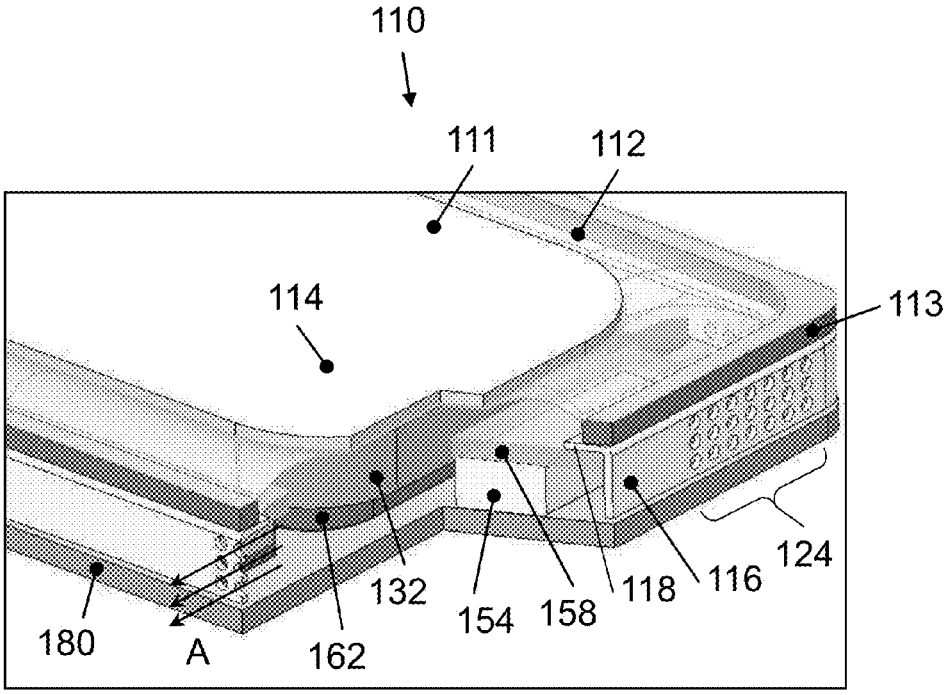
FIG. 8 shows a top perspective partial cutaway view of a rectangular micro speaker according to the first embodiment of the invention.
Figure 9A:
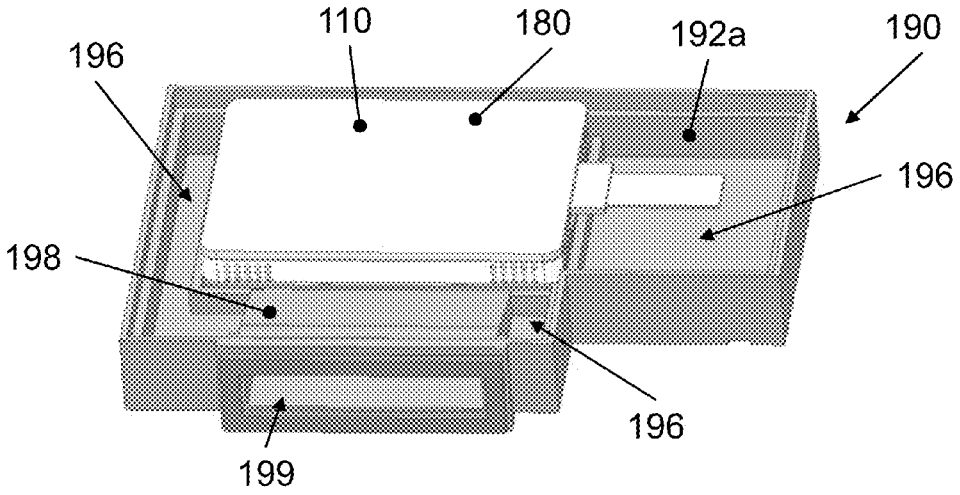
FIG. 9A shows a top perspective view of a rectangular micro speaker assembled into a first portion of an enclosure according to the first embodiment of the invention.
Figure 9B:
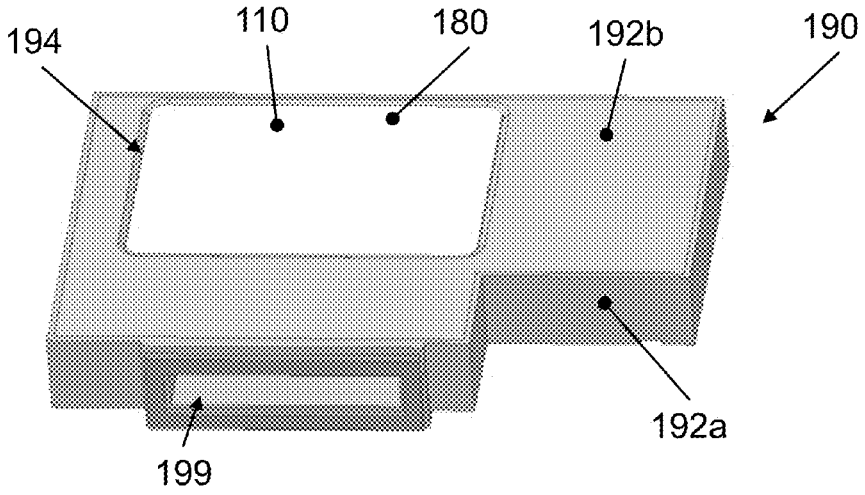
FIG. 9B shows a top perspective view of a rectangular micro speaker assembled into an enclosure according to the first embodiment of the invention.
Figure 10:
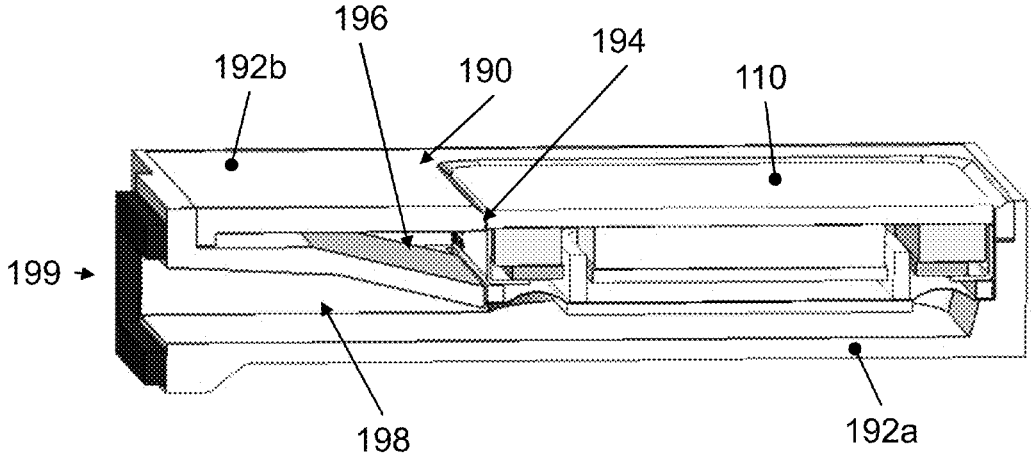
FIG. 10 shows a side perspective section view of a rectangular micro speaker assembled into an enclosure according to the first embodiment of the invention.
Figure 11:
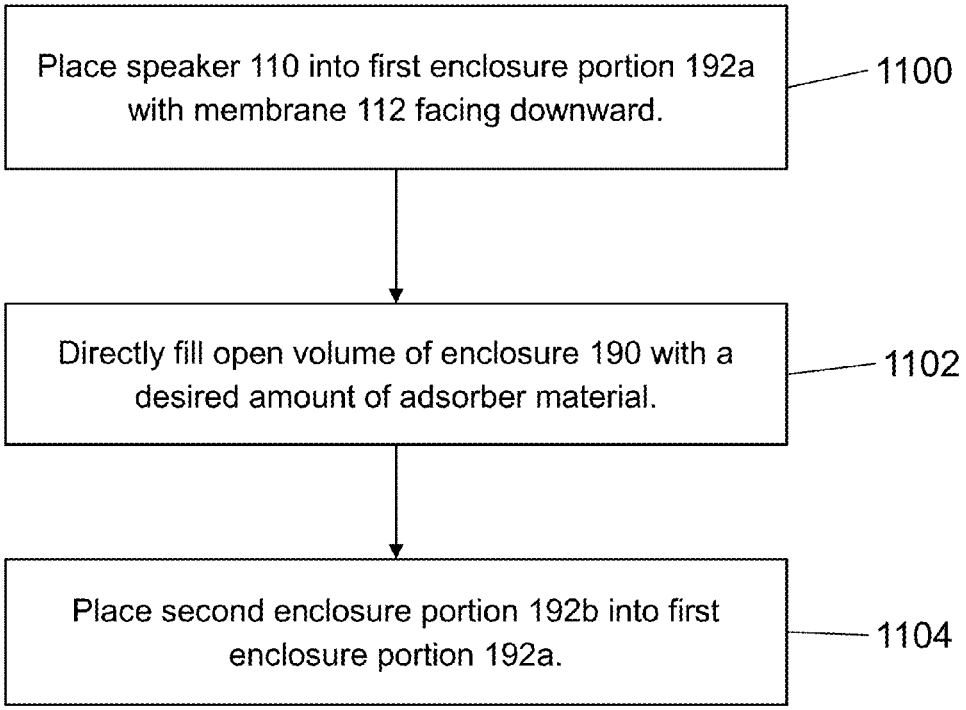
FIG. 11 is a flowchart describing a method of assembling the rectangular micro speaker into an enclosure according to the first embodiment of the invention.

The relevant parts of a first embodiment of the invention are shown in FIGS. 4-11. FIG. 4 shows an exploded perspective view of the relevant parts of a rectangular speaker 110. FIG. 5 shows a perspective view of an assembly of a coil 132 and flexible printed circuit 136. FIG. 6A shows a top perspective view of the relevant parts of a rectangular speaker 110. FIG. 6B shows a bottom perspective view of the relevant parts of a rectangular speaker 110. FIG. 7 shows a side perspective section view of the relevant parts of a rectangular speaker 110. FIG. 8 shows a top perspective partial cutaway view of the relevant parts of a rectangular speaker 110. FIG. 9A shows a top perspective view of the relevant parts of a rectangular speaker 110 assembled into a first portion 192*a* of an enclosure 190. FIG. 9B shows a top perspective view of the relevant parts of a rectangular speaker 110 assembled into an enclosure 190. FIG. 10 shows a side perspective section view of the relevant parts of a rectangular speaker 110 assembled into an enclosure 190. FIG. 11 is a flowchart describing a method of assembling the rectangular micro speaker 110 into an enclosure 190.

With reference to FIG. 4, speaker 110 comprises a membrane assembly 111, a collar 116, a coil assembly 130, and a magnet system 150. Membrane assembly 111 includes a membrane 112, a membrane ring 113 extending around the perimeter of membrane 112, and a membrane plate 114 to stiffen membrane 112. Membrane 112 may be built out of one or more layers of material, such as, for example, Ethere Ketone (PEEK), Acrylate and/or Thermoplastic Elastomeric (TEP), Polyetherimide (PEI), and/or other materials known in the art.

Magnet system 150 comprises a perimeter magnet assembly 152, a pot assembly 160, and an air gap 170 formed therebetween. Perimeter magnet assembly 152 includes four magnets 154 arranged on the rectangular sides of the rectangular speaker 110 and ring plate 158 fixed to magnets 154. Pot assembly 160 includes pot plate 180, magnet 162 arranged in the center of pot plate 180, and top plate 164 fixed to magnet 162 opposite pot plate 180. Perimeter magnet assembly 152 and pot assembly 160 form magnetic field guide 168. Magnetic field guide 168 guides and focuses the magnetic field of magnets 154 and 162 in an air gap 170 (see FIG. 7) between perimeter magnet assembly 152 and center magnet assembly 160, into which coil 132 of coil assembly 130 is arranged in the assembled speaker 110.

With continued reference to FIG. 4 and to FIG. 5, coil assembly 130 includes coil 132, leads 134, and flexible printed circuit 136. An electrical signal to drive coil 132 is fed into coil 132 through flexible printed circuit 136 and leads 134. Coil 132 of assembled speaker 110 is fixed to membrane 112 with an adhesive, such as, for example, glue, tape, or other adhesives known in the art. Unlike prior art micro speakers, leads 134 of coil 132 are directly connected to flexible printed circuit 136. Flexible printed circuit 136 includes a pair of contact pads 138 on a first terminal end of flexible printed circuit 136 which are in electrical communication with contact pads 140 on a second terminal end of the printed circuit 136 opposite the first. The electrical communication between contact pads 140 and 138 may be accomplished using traces and/or vias as is known in the art. Leads 134 are electrically connected by a solder connection to contact pads 138 to permit an electrical signal to flow from a source (not shown) into contact pads 140, through traces and/or vias in flexible printed circuit 136, through contact pads 138, through leads 134 and into coil 132. It will be understood by those in the art, that in various embodiments, the electrical connection between leads 134 and flexible printed circuit 136 may be accomplished in a variety of ways known in the art, for example, by inserting leads 134 into an electrical connector affixed to flexible printed circuit 136.

Unlike prior art micro speaker 10 shown in FIGS. 1, 2A, and 2B, micro speaker 110 does not require contact pads 92*t* and contact pads 92*b* to be included in frame 90. By eliminating the additional components required to transmit the electrical signal from the source to coil 132, the size may be reduced, the component and manufacturing costs may be reduced, and durability and sound quality may be increased for speaker 110 as compared to prior art speaker 10. For example, by connecting leads 134 directly to contact pads 138 of flexible printed circuit 136, the number of electrical connections are reduced to one for each lead 134.

As shown in FIGS. 4 and 5, leads 134 of coil 132 extend from the side of coil 132 proximate flexible printed circuit 136 and each lead 134 forms a short loop. This allows leads 134 to be shorter in length than leads 34 of prior art micro speaker 10. However, in other embodiments, for example, leads 134 of coil 132 may extend from the side of coil 132 distal flexible printed circuit 136 and loop inward to be electrically connected to contact pads 138 of flexible printed circuit 136. As shown, leads 134 extend from the bottom of coil 132 and may be substantially horizontal and substantially in-plane with flexible printed circuit 136 when coil is in the rest position. In various embodiments, speaker 110 may also include one or more of the support members for supporting coil 132 and/or leads 134 as described in U.S. Provisional Application 62/147,801, filed on Apr. 15, 2015, entitled "Speaker with Supported Coil Wire," the entirety of which is incorporated by reference herein. Other features of coil assembly 130 are described in the U.S. Provisional Application filed on Oct. 6, 2015, having Attorney Docket Number 112256-0091, entitled "Electroacoustic Transducer with Flexible Coilwire Connection," the entirety of which is incorporated by reference.

With reference to FIGS. 4, 6A, 6B, 7, and 8, collar 116 includes a first portion 118 that is substantially horizontal and substantially parallel with pot plate 180. A substantially rectangular opening 120 is provided in first portion 118 through which coil 132 may translate during operation of speaker 110. First portion 118 serves as a rim to which membrane ring 113 is affixed typically, for example, by glue or adhesive. Extending downward and substantially perpendicular from the sides of first portion 118 of collar 116 is a second portion, shown as sidewall 122. Sidewall 122 extends around the perimeter of collar 116.

Collar 116 further includes a stabilizing tab 126 extending substantially horizontally from sidewall 122. As shown in FIGS. 6A and 7, stabilizing tab 126 interfaces with flexible printed circuit 136, serves to stabilize flexible printed circuit 136, provides protection between the electrical connection between leads 134 and contact pads 138, and maintains the positions of collar 116 and coil assembly 130 in speaker 110. Stabilizing tab 126 is affixed to flexible printed circuit 136 using an adhesive 142 (see FIG. 4), such as, for example, glue, tape, or other adhesives known in the art.

Sidewall 122 includes a population of openings 124 extending through sidewall 122 proximate the corners of collar 116. Preferably, there are two arrays of openings 124 proximate the corners of collar 116. Openings 124 are shown as substantially circular holes arranged in rows and columns. Each side of sidewall 122 of collar 116 is shown with thirty (30) openings 124 arranged in two arrays of fifteen (15) openings 124. In various embodiments, for example, openings 124 may be laser cut into sidewall 122. Openings 124 serve as side vents which permit airflow between a back volume 196 (see FIG. 10) and the back volume side of membrane 112 (see Arrows A in FIG. 8). As illustrated in FIGS. 4 and 8, openings 124 are substantially aligned with the gaps 156 between magnets 154 of perimeter magnet assembly 152 and thus speaker 110 includes a substantially clear air pathway between back volume 196 (see FIG. 10) and the back volume side of membrane 112. Therefore, openings 124 permit an undistorted vibration of membrane 112 in response to the electrical signal fed into coil 132. With the inclusion of openings 124 on collar 116, back vents are not required in pot plate 180 as shown in FIGS. 2A and 2B. By not requiring back vents on pot plate 180, the geometry and/or features of pot plate 180 can be simplified as compared to pot plate 80 of prior art speakers, thus reducing component cost.

It will be understood that the number and/or the size of openings 124 may be altered to provide the appropriate side venting to a back volume (not shown) to achieve the desired acoustic performance for speaker 110. That is, the total open area of openings 124 may be modified according to the design requirements of a particular application. Likewise, the placement of opening 124 on sidewall 122 is not limited to being adjacent to the corners of sidewall 122 nor substantially aligned with the gaps 156 between magnets 154 of perimeter magnet assembly 152. For example, openings 124 may be located at the midpoint along one or more sides of sidewall 122. In other embodiments, for example, openings 124 may be distributed, either evenly or unevenly, along one or more sides of sidewall 122. Preferably, the open area of openings 124 on each side of sidewall 122 of collar 116 is substantially equal. This permits substantially equal intake and exhaust of air through openings 124 on all sides of sidewall 122 which promotes substantially equal vertical translation of membrane 112 across the entire membrane 112. That is, this tends to reduce or eliminate tumbling of membrane 112 which, in turn, reduces or eliminates non-uniform stresses upon membrane 112 which could lead to premature failure of membrane 112. Therefore, by reducing tumbling of membrane 112, acoustic performance and quality are increased and durability of membrane 112 and speaker 110 are increased.

As described in greater detail elsewhere herein, speaker 110 may be placed in an enclosure 190 into which an adsorber material may be directly filled. To prevent the adsorber from coming into contact with magnets 154, 162, coil 132, and membrane 112 of speaker 110, openings 124 may have a maximum dimension smaller than an adsorber material filled into an enclosure. The adsorber material may be, for example, the zeolite material described in U.S. Published Patent Application 2013/0170687, published on Jul. 4, 2013, entitled "Loudspeaker System with Improved Sound," the entirety of which is incorporated herein by reference.

Collar 116 is preferably formed of a sheet of stainless steel having a thickness from about 0.1 mm to about 0.2 mm (e.g., about 0.1 mm, about 0.11 mm, about 0.12 mm, about 0.13 mm, about 0.14 mm, about 0.15 mm, about 0.16 mm, about 0.17 mm, about 0.18 mm, about 0.19 mm, about 0.20 mm). In various embodiments, the thickness of collar 116 may be less than about 0.1 mm. In various other embodiments, the thickness of collar 116 may be greater than about 0.2 mm. It will be understood, that in other embodiments, for example, collar 116 may be formed from a variety of materials including, but not limited to, metals (e.g., steel, aluminum, titanium, magnesium, and alloys thereof), plastics (e.g., acrylonitrile butadiene styrene (ABS), polyvinyl chloride (PVC)), composites (e.g., carbon fiber- and aramid-reinforced polymers), etc. Collar 116 may be formed by, including, but not limited to, stamping, casting, injection molding, additive manufacturing, etc.

The assembled speaker 110 is shown in FIGS. 6A, 6B, 7, and 8. Membrane assembly 111 is affixed to collar 116 which is, in turn, affixed to flexible printed circuit 136 (e.g., by adhesive 142) by support tab 126. Flexible printed circuit 126 is affixed to pot plate 180, to which perimeter magnet assembly 152 and center magnet 162 are affixed. In various embodiments, for example, collar 116 may also be affixed to pot plate to increase stiffness of speaker 110.

Now with reference to FIGS. 9A, 9B and 10, assembled speaker 110, is shown as installed in an enclosure 190. Enclosure 190 includes a first enclosure portion 192*a* and a second enclosure portion 192*b*. A back volume 196 is defined by first enclosure portion 192*a*, second enclosure portion 192*b*, and speaker 110. Second enclosure portion 192*b* includes an opening 194 that is substantially the same size as pot plate 180 of speaker 110. When speaker 110 is assembled into first enclosure portion 192*a* and second enclosure portion 192*b* is placed in first enclosure portion 192*a*, pot plate 180 serves to seal opening 194. By having pot plate 180 insert into and close opening 194, the external size of enclosure 190 can be reduced while maximizing the back volume 196 of enclosure 190. Thus a larger speaker 110 and a larger back volume 196 can be used in a device as compared to a prior art speaker 10 and prior art enclosure 100. Or, alternatively, a smaller speaker 110 having the same acoustic performance as prior art speaker 10 can be used in a device.

With continued reference to FIGS. 9A, 9B, and 10 and with reference to FIG. 11, a method of assembling speaker 110 into enclosure 190 and directly filling back volume 196 with an adsorber is described. At step 1100, speaker 110 is placed into first enclosure portion 192*a* with membrane 112 facing downward. As shown in FIG. 9A, membrane 112 is in communication with sound path 198 which terminates in side firing port 199 (see FIG. 10). After speaker 110 is placed into first enclosure portion, an open volume remains in first enclosure portion 192*a*. Open volume will become back volume 196 when second enclosure portion 192*b* is placed in first enclosure portion 192*a*. At step 1102, a desired amount of adsorber material is directly filled into the open volume. Because the entirety of the open volume is easily accessible and because of the side venting provided by openings 124, the entirety of the adsorber desired or specified for the particular design can be easily filled into enclosure 190. Because the maximum size of each individual opening 124 is less than the size of the adsorber material, the adsorber can be filled directly against speaker 110 without any risk of adsorber material coming into contact with magnets 154, 162, coil 132, and membrane 112. Furthermore, with inclusion of side openings 124 and the size thereof, a separator plate 106 is not required like in speaker 10. At step 1104, after the specified amount of adsorber is directly filled into first enclosure portion 192*a*, second enclosure portion 192*b* is placed into first enclosure portion 192*a*. Second enclosure portion 192*b* may then be sealed against first enclosure portion 192*a* and pot plate 180. Therefore, unlike prior art designs, there is no small fill hole which needs to be sealed with a cover.

While various steps are described herein in one order, it will be understood that other embodiments of the method can be carried out in any order and/or without all of the described steps without departing from the scope of the invention.

Although enclosure 190 is illustrated with a sound path 198 terminating in side firing port 199, it will be understood that in various embodiments, the enclosure of speaker 110 may include a sound path terminating in a top or bottom firing port. Enclosure 190 may further includes a passageway through which flexible printed circuit 136 exits so that it may be connected to a source (not shown) for driving speaker 110.

Figure 12A:
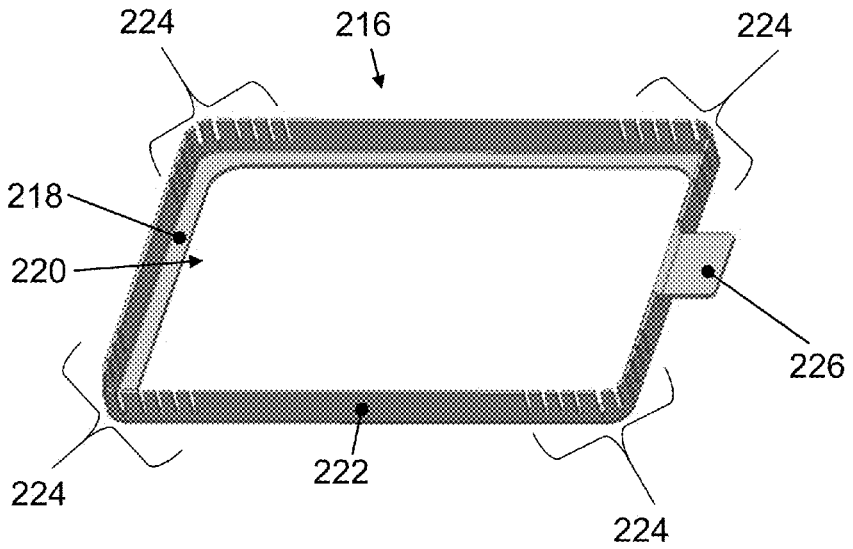
FIG. 12A is a bottom perspective view of a collar of a rectangular micro speaker according to a second embodiment of the invention.
Figure 12B:
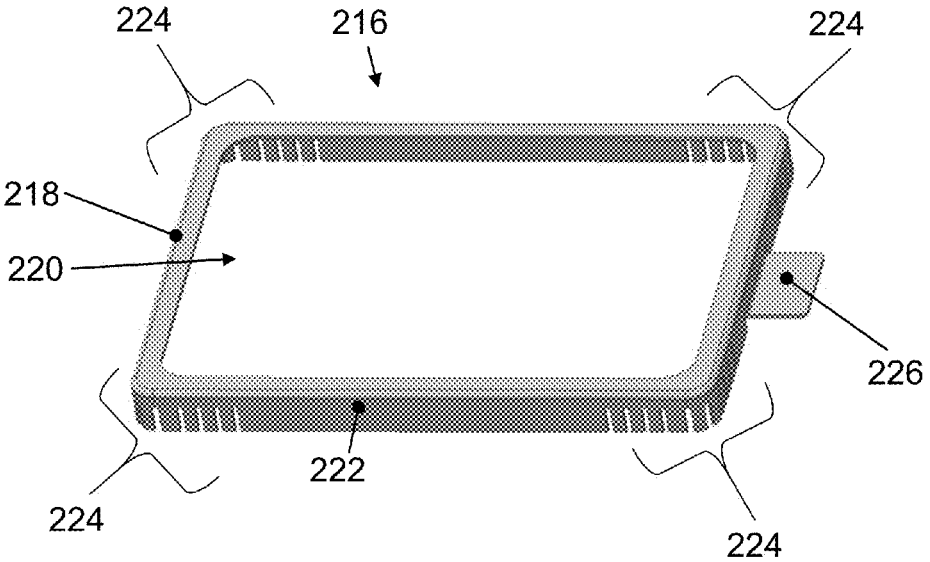
FIG. 12B is a top perspective view of a collar of a rectangular micro speaker according to the second embodiment of the invention.

Another embodiment of collar 216 of the invention is illustrated in FIGS. 12A, 12B and is described below. Some features of one or more of collars 116 and 216 are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

Collar 216 has a first portion 218 that is substantially horizontal and substantially parallel with a pot plate 180. A substantially rectangular opening 220 is provided in first portion 218 through which a coil 132 may translate during operation of a speaker 110. First portion 218 serves as a rim to which the membrane ring 113 of a membrane 112 is affixed typically, for example, by glue or adhesive. Extending downward and substantially perpendicular from the sides of first portion 218 of collar 216 is a second portion, shown as sidewall 222. Sidewall 222 extends around the perimeter of collar 216.

Sidewall 222 includes a population of openings 224 extending through sidewall 222 proximate the corners of collar 216. Openings 224 are shown as slots arranged in columns. The slot openings 224 are shown as extending from the terminal end of sidewall 222 up toward first portion 218 of collar 216. In various embodiments, for example, openings 224 may be laser cut into sidewall 222. Openings 224 serve as side vents which permit airflow between a back volume (not shown) and the back volume side of a membrane 112. Openings 224 may be substantially aligned with the gaps between magnets 154 of magnet system 150 and thus a speaker may include a substantially clear air pathway between the back volume and the back volume side of membrane 112. Therefore, openings 224 permit an undistorted vibration of membrane 112 in response to the electrical signal fed into coil 132. With the inclusion of openings 224 on collar 216, back vents are not required in pot plate 180 as shown in FIGS. 2A and 2B. By not requiring back vents on pot plate 180, the geometry and/or features of pot plate 180 can be simplified as compared to pot plate 80 of prior art speakers, thus reducing component cost.

Collar 216 further includes a stabilizing tab 226 extending substantially horizontally from sidewall 222. Stabilizing tab 226 functions the same as stabilizer tab 126 shown in FIGS. 4, 6A, 6B, and 7. Stabilizing tab 226 interfaces with flexible printed circuit 136, serves to stabilize flexible printed circuit 136, provides protection between the electrical connection between leads 134 and contact pads 138, and maintains the positions of collar 216 and coil assembly 130 in the speaker. Stabilizing tab 226 is affixed to flexible printed circuit 136 using an adhesive 142 (see FIG. 4), such as, for example, glue, tape, or other adhesives known in the art.

While embodiments of the audio transducer are shown and described as having a rectangular shape, it will be understood that in other embodiments, the audio transducer may have a variety of shapes, including, but not limited to, circular and ovular. Accordingly, the invention is not limited to audio transducers having a rectangular shape.

In closing, it should be noted that the invention is not limited to the above mentioned embodiments and exemplary working examples. Further developments, modifications and combinations are also within the scope of the patent claims and are placed in the possession of the person skilled in the art from the above disclosure. Accordingly, the techniques and structures described and illustrated herein should be understood to be illustrative and exemplary, and not limiting upon the scope of the present invention. The scope of the present invention is defined by the appended claims, including known equivalents and unforeseeable equivalents at the time of filing of this application.

What is claimed is:

1. An audio transducer, comprising:
a membrane assembly comprising a membrane;
a magnet assembly comprising a pot plate having a perimeter; and
a collar sandwiched between the membrane assembly and the pot plate, the collar comprising:
a sidewall extending along each side of the collar perpendicular to the pot plate; and
one or more openings extending through the sidewall, wherein the openings are located on each side of the collar and wherein the openings provide an equal open area on each side of the collar.

2. The audio transducer of claim 1, wherein the magnet assembly further comprises a population of magnets arranged proximate the perimeter of the pot plate, and one or more gaps, with a gap between each magnet; and wherein the openings in the sidewall of the collar are located proximate the gaps.

3. The audio transducer of claim 2, wherein the openings in the sidewall of the collar are aligned with the gaps in the magnet assembly to provide a clear air pathway through the openings.

4. The audio transducer of claim 1, wherein the collar is rectangular and has four corner regions and the openings are arranged in arrays proximate each corner region.

5. The audio transducer of claim 4, wherein the openings are arranged in two arrays on each side of the collar.

6. The audio transducer of claim 1, wherein the openings are circular.

7. The audio transducer of claim 1, wherein the openings are arranged in rows and columns.

8. The audio transducer of claim 1, wherein the openings are arranged to reduce tumbling of the membrane of the membrane assembly.

9. The audio transducer of claim 1, wherein the openings are slots.

10. The audio transducer of claim 1, wherein the collar further comprises a rim extending inward from the sidewall through which a rectangular opening extends.

11. The audio transducer of claim 1, wherein the collar further comprises a stabilizing tab extending from the sidewall along one side of the collar.

12. The audio transducer of claim 1, wherein the openings are located in the sidewall to permit an undistorted vibration of the membrane of the membrane assembly.

13. An audio transducer assembly, comprising:

an audio transducer comprising:

a membrane;

magnet system having a pot plate, the pot plate having a perimeter; and a collar sandwiched between the membrane and the pot plate, the collar comprising:

a sidewall extending perpendicular to the pot plate; and one or more openings extending through the sidewall, wherein the openings are located on one or more sides of the collar and wherein the openings provide an equal open area on each of the one or more sides of the collar; and an enclosure in which the audio transducer is housed, the enclosure and audio transducer defining a back volume;

wherein the openings in the sidewall permit side venting air flow through the openings between the back volume and the audio transducer.

14. The audio transducer assembly of claim 13, further comprising:

an adsorber material located in the back volume, wherein at least a portion of the adsorber material is in contact with the sidewall of the audio transducer; and wherein the openings in the sidewall have a maximum dimension smaller than the adsorber material so as to prevent the adsorber material from travelling through the openings into the audio transducer.

15. The audio transducer assembly of claim 13, wherein the enclosure comprises:

a first enclosure portion; and a second enclosure portion, wherein the second enclosure portion includes an opening corresponding to the pot plate of the audio transducer, such that when the audio transducer is placed in the first enclosure portion and the second enclosure portion is placed in the first enclosure portion, the pot plate seals the opening in the second enclosure portion.

16. The audio transducer assembly of claim 13, wherein the magnet system further comprises a population of magnets arranged proximate the perimeter of pot plate, and one or more gaps, with a gap between each magnet; and wherein the openings in the sidewall of the collar are located proximate the gaps.

17. The audio transducer assembly of claim 16, wherein the openings in the sidewall of the collar are aligned with the gaps in the magnet system to provide a clear air pathway through the openings.

18. A method of assembling a audio transducer assembly comprising (i) an enclosure having a first enclosure portion and a second enclosure portion, and (ii) a audio transducer having a membrane, a magnet assembly having a pot plate, and a collar sandwiched between the membrane and the pot plate, the collar having a sidewall with one or more openings extending through the sidewall, wherein the openings are located on one or more sides of the collar and wherein the openings provide an equal open area on each of the one or more sides of the collar, the method comprising:

i) placing the audio transducer into the first enclosure portion;

ii) filling the first enclosure portion with a desired amount of adsorber material, wherein the adsorber material may be filled directly against the audio transducer and wherein the openings in the sidewall have a maximum dimension smaller than the adsorber material so as to prevent the adsorber material from travelling through the openings into the audio transducer; and iii) placing the second enclosure portion into first enclosure portion.

19. The method of assembling the audio transducer assembly according to claim 18, wherein the second enclosure portion includes an opening corresponding to the pot plate, such that the method further comprises sealing the opening in the second enclosure portion with the pot plate of the audio transducer.

* * * * *